US006776543B1

(12) United States Patent
Hall et al.

(10) Patent No.: US 6,776,543 B1
(45) Date of Patent: Aug. 17, 2004

(54) FIBER OPTIC PRINT MEDIA THICKNESS SENSOR AND METHOD

(75) Inventors: Jeffrey D. Hall, Meridian, ID (US); Tim M. Hoberock, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 10 days.

(21) Appl. No.: 10/358,752

(22) Filed: Feb. 4, 2003

(51) Int. Cl.[7] ..... B41J 11/20

(52) U.S. Cl. ..... 400/56; 250/559.01; 356/482; 356/496; 356/503

(58) Field of Search ..... 400/56; 101/483; 347/19, 106; 356/482, 496, 503; 250/559.01, 548; 385/88

(56) References Cited

U.S. PATENT DOCUMENTS

| | | | | |
|---|---|---|---|---|
| 3,580,082 A | | 5/1971 | Strack | |
| 3,602,037 A | | 8/1971 | Neu | |
| 4,163,397 A | | 8/1979 | Harmer | |
| 4,275,296 A | | 6/1981 | Adolfsson | |
| 4,307,618 A | | 12/1981 | James et al. | |
| 4,674,900 A | | 6/1987 | Erzsebet et al. | |
| 4,711,246 A | | 12/1987 | Alderson | |
| 4,886,361 A | | 12/1989 | Furstenau | |
| 4,977,330 A | * | 12/1990 | Batchelder et al. | 250/539.27 |
| 5,120,951 A | | 6/1992 | Small | |
| 5,156,464 A | | 10/1992 | Sakai | |
| 5,420,688 A | | 5/1995 | Farah | |
| 5,483,347 A | * | 1/1996 | Hollmann | 356/624 |
| 5,531,434 A | | 7/1996 | Kerschner | |
| 5,787,212 A | | 7/1998 | Hong et al. | |
| 5,818,982 A | | 10/1998 | Voss et al. | |
| 5,962,861 A | | 10/1999 | Fowler | |
| 6,008,898 A | | 12/1999 | Furstenau et al. | |
| 6,061,139 A | * | 5/2000 | Takezawa et al. | 356/407 |
| 6,204,922 B1 | * | 3/2001 | Chalmers | 356/630 |
| 6,247,861 B1 | | 6/2001 | Wotton | |
| 6,655,854 B1 | * | 12/2003 | Nguyen et al. | 385/88 |

FOREIGN PATENT DOCUMENTS

| | | |
|---|---|---|
| WO | WO 96/08695 | 3/1996 |

* cited by examiner

*Primary Examiner*—Eugene H. Eickholt

(57) ABSTRACT

The present invention is directed to a fiber optic media thickness sensor used in a print media or document processing device. The invention is further directed to a method for measuring media thickness in a media processing device using a fiber optic sensor.

17 Claims, 4 Drawing Sheets

FIBER OPTIC PRINT MEDIA THICKNESS SENSOR AND METHOD

BACKGROUND OF THE INVENTION

1. Field of the Invention

This invention relates generally to printers and copiers and the like, and more particularly, relates to adjustments by such devices in response to variations in print media characteristics.

2. State of the Art

A myriad of document processing devices have been developed, including printers, photocopy machines, scanners, as well as other devices that either create images and patterns on print media (e.g., printers) or analyze images and patterns already resident on media (e.g., scanners). Complications arise in the use of these devices when media, having variations in media characteristics, are used. For example, printers may be presented with a myriad of print media, such as paper, which exhibit variations in thickness and stiffness and requires individualized image processing parameters in order to create an acceptable image on the specific print media. Without such image processing adaptation, the print quality may become unacceptable and may even result in damage to the processing device.

Insight into the media characteristic of the media being acted upon by a document processing device enables the device to adapt and provide improved processing services to the media. For example, thicker media may require alternative handling such as alterations to forces associated with the "pick" or lifting forces for removing the media from a document processing device storage tray. Furthermore, document processing device attachments such as duplexers or output bins also have specifications including a range of media characteristics compatible with the attachment devices. Yet another concern of document processing devices, particularly printers and copiers, results from the variations in fuser temperature profiles as a function of the media thickness. Therefore, it would be advantageous to determine media characteristics such as thickness and stiffness of the media in order to more advantageously alter document processing device parameters.

In yet another printing process, namely the application of toner to the print media, it should be appreciated that the thicker the print media, the more electrical charge must be applied to the media in order to attract an adequate amount of toner. Therefore, there is a need for providing an improved sensor capable of real or near real-time media evaluation to quantify the media characteristics allowing the document processing device to adjust the performance of the device's imaging processes.

Mechanical media thickness measurement devices are known in the art. One type of mechanical thickness sensor uses a mechanical arm assembly coupled to a measurement circuit. The mechanical arm engages the surface of the media under evaluation. The measurement circuit measures the displacement of the media or the mechanical arm and generates a signal indicative of the media thickness. The present invention provides an alternative to mechanical techniques for detecting the thickness of print media.

BRIEF SUMMARY OF THE INVENTION

The present invention is directed to a fiber optic media thickness sensor used in a print media or document processing device. The invention is further directed to a method for measuring media thickness in a media processing device using a fiber optic sensor.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
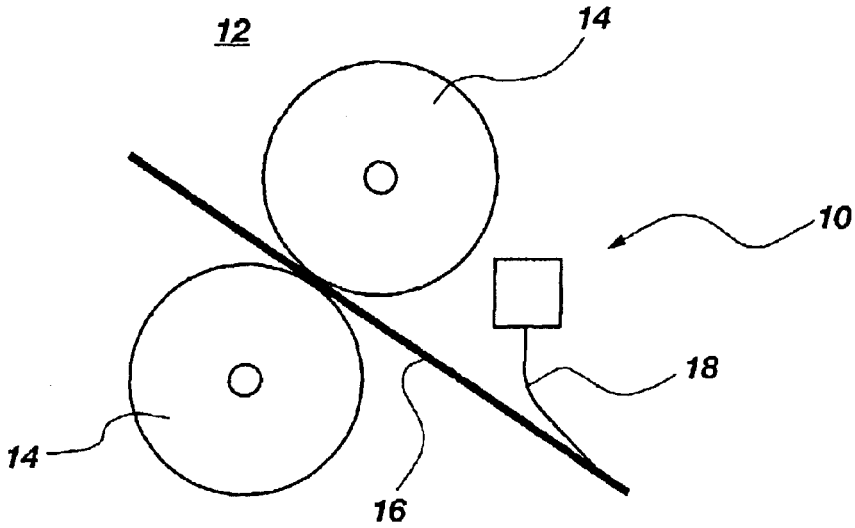
FIG. 1 is a simplified illustration of a thicker media passing through a media thickness sensor, in accordance with an embodiment of the present invention.

FIG. 1 illustrates a simplified application of a media thickness sensor 10 as deployed within a document processing device, a portion of which is depicted as document processing device 12. Those of skill in the art appreciate that document processing device 12 further comprises other subsystems, such as image processing and media storage aspects which, for clarity, are not illustrated in FIG. 1. A media processing path of document processing device 12 includes rollers or other guidance mechanism 14 directing a media 16 along a media processing path. Print media 16 traverses at least a portion of the media path before encountering media thickness sensor 10. Media thickness sensor 10 provides a real time or near real time characterization of the thickness characteristic of media 16 within document processing device 12. By way of illustration of the functional operation of media thickness sensor 10, FIG. 1 illustrates a relatively thick media 16 deflecting a sensing fiber 18 of media thickness sensor 10. Sensing fiber 18 includes a first or fixed end and a second or free end that extends into the media processing path for encountering the media and being deflected thereby.

Figure 2:
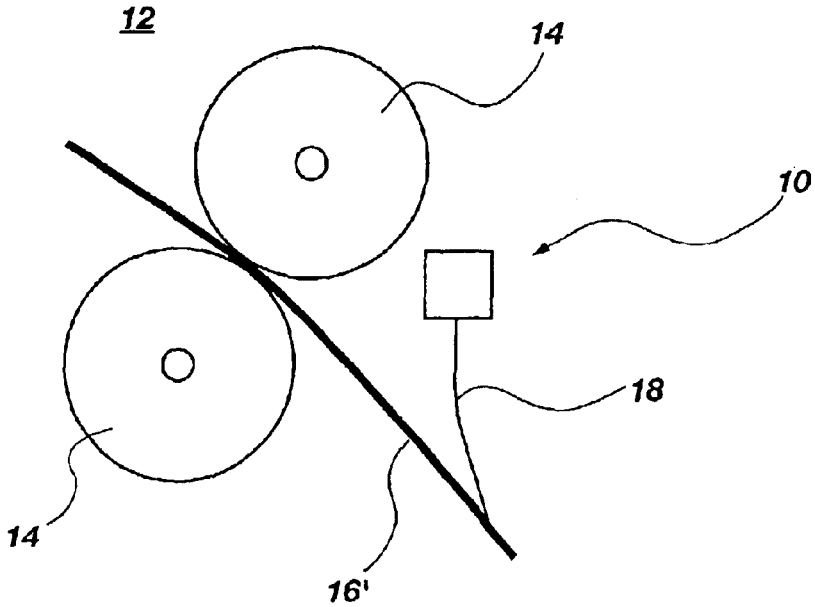
FIG. 2 is a simplified illustration of a thinner media passing through a media thickness sensor, in accordance with an embodiment of the present invention.

Similarly, FIG. 2 illustrates the document processing device 12, as introduced in FIG. 1, except with a thinner media 16'. In FIG. 2, thinner media 16', likewise passes through guidance mechanisms 14 to encounter media thickness sensor 10 within document processing device 12. As best seen by comparing FIGS. 1 and 2, the deflection of sensing fiber 18 by thinner media 16' is smaller than that of thicker media 16. Media thickness sensor 10, therefore, detects a smaller thickness media and quantifies the thickness of the media for use by imagining processes within document processing device 12.

Figure 3:
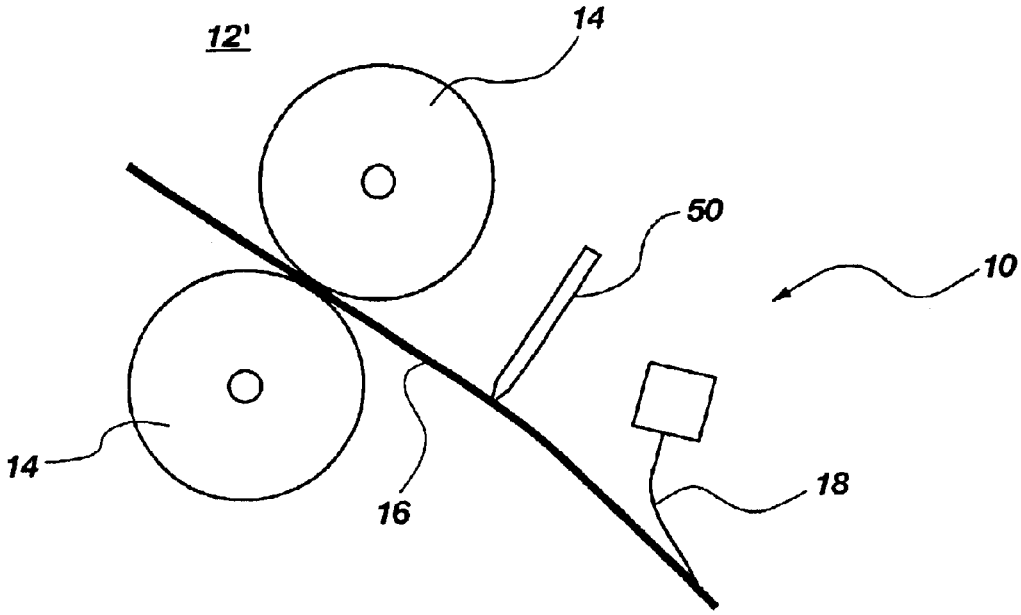
FIG. 3 illustrates an alternate embodiment wherein media deflection is induced.

FIG. 3 illustrates an alternate embodiment of a document processing device wherein deflection of the print media is induced. In FIG. 3, document processing device 12' includes a media deflector 50 positioned upstream in the media path from media thickness sensor 10. Deflector 50 applies a known force and deflects media 16. Media 16 then deflects sensing fiber 18 as it passes through media thickness sensor 10. The amount the media 16 deflects sensing fiber 18 varies according to the amount of force that deflector 50 applies to media 16. A larger deflection of media 16 by deflector 50, for example, will cause a smaller deflection of sensing fiber 18 by media 16. In the embodiment of FIG. 3, deflector 50 may also carry the load of deflecting media 16, rather than sensing fiber 18. Consequently, a sensing fiber 18 used with deflector 50 may be more flexible and, perhaps, more sensitive, that the stiffer sensing fiber 18 in the embodiment of FIGS. 1 and 2. Furthermore, deflector 50 also enhances the deflection of media 16 through application of a known load to media 16 thereby exaggerating the deflection of media 16 and providing additional deflection-resolution to the sensing fiber 18. It should be appreciated that media deflector 50 may also be implemented to reduce deflection such as in the case where media deflector 50 attracts media 16.

Figure 4:
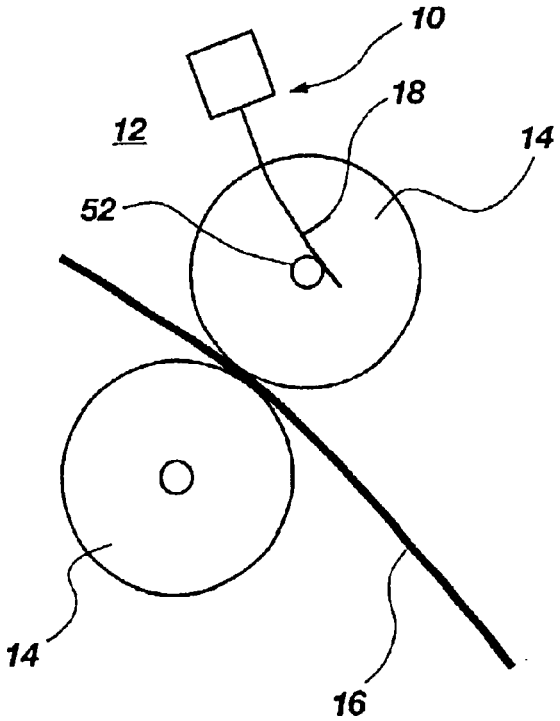
FIG. 4 illustrates detection of media thickness by monitoring roller deflection, in accordance with another embodiment of the invention.

In the embodiment of FIG. 4, media 16 passes through guidance mechanisms 14 which deflect, separate or otherwise move in response to the presence of media 16. The deflection of media guidance mechanisms by media 16 is detected by locating media thickness sensor 10 in proximity to at least a portion of guidance mechanism 14 that deflects in response to the presence of media 16. In FIG. 4, media thickness sensor 10 indirectly senses the media thickness by monitoring the deflection of components of guidance mechanisms 14, an example of which is the monitoring of the deflection of a roller profile 52 illustrated in FIG. 4 as a roller axle. Various other tracking or monitoring profiles are contemplated within the scope of the present invention.

Figure 5:
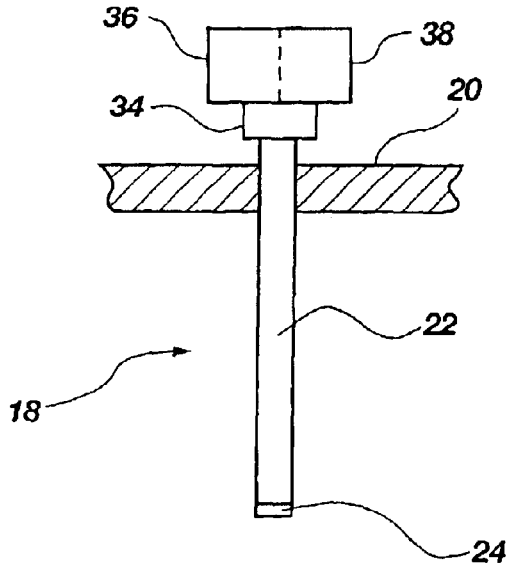
FIG. 5 is a cross-sectional view of a sensing fiber within a thickness sensor, in accordance with an embodiment of the present invention.

FIG. 5 illustrates a cross-sectional view of a sensing fiber 18. As illustrated, sensing fiber 18 operates as an optical fiber attached at a first end to a mounting housing 20 for providing a rigid base from which sensing fiber 18 may deflect when acted upon by the forces exerted by media 16. Mounting housing 20, while illustrated as a discrete housing, may also be adequately held rigid by a coupler or other assembly capable of receiving a sensing fiber 18 therein.

Sensing fiber 18 is comprised of an optical fiber 22 which includes, on a second end, a mirror 24 or other reflective surface capable of reflecting light, originating from a light source at a first or fixed end of the flexible optical fiber, back again to the first or fixed end of the flexible optical fiber. Those of skill in the art appreciate that the occurrence of any deflection within optical fiber 22 results in an attenuation of light reflected back by mirror 24.

Sensing fiber 18 operates based upon the principle of light interference for obtaining originating and reflected light differences for correlating with media thickness. When propagating light is injected by light source 36 via coupler 34 into the first end of optical fiber 22 located on the mounting housing end of optical fiber 22, it propagates down the core of the fiber and is reflected by mirror 24 back through the fiber to the detector 38, also located on the first end of the optical fiber. The detector 38 measures the quantity of received reflected light and generates an electronic signal corresponding to the deflection of the optical fiber. Those of ordinary skill in the art appreciate that light losses occur when the bend radius of the optical fiber exceeds the critical angle necessary to confine the light to the core area of the fiber. When the fiber is flexed, the amount of light reflecting back to the detector is diminished accordingly and may be quantified to correlate to a media thickness.

Figure 6:
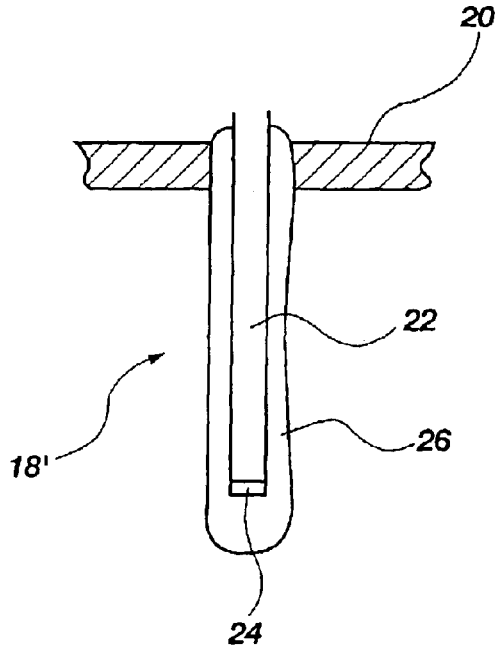
FIG. 6 is a cross-sectional view of a sensing fiber within a thickness sensor having an encapsulated resiliency coating, in accordance with an embodiment of the present invention.

FIG. 6 illustrates another embodiment of a sensing fiber 18' rigidly mounted in a mounting housing 20. Sensing fiber 18' includes a resiliency coating 26 which may be for protectively coating optical fiber 22 from abrasion associated with media 16. Additionally, resiliency coating 26 may also be used to control the rigidity and flexibility of optical fiber 22. It should be appreciated that resiliency coating 26 may be comprised of substances such as silicone, ABS, PCABS, or the like. Furthermore, resiliency coating 26 may be applied either by encapsulating optical fiber 22 or to selectively apply a coating to the optical fiber by other means compatible with processing and handling of optical fibers.

The optical fiber may be manufactured in accordance with typical fiber optic principles including composition and size. Additionally, the fiber may be mirror-coated on the end as mirror 24 and may optionally additionally include mirror-coating on the sidewalls. Such an implementation may be manufactured by cladding the side and end walls with a higher index of refraction material so that light transmitted through the fixed-end toward the free-end will experience significant internal reflection losses when the resilient fiber is deflected by the presence of the print media.

Figure 7:
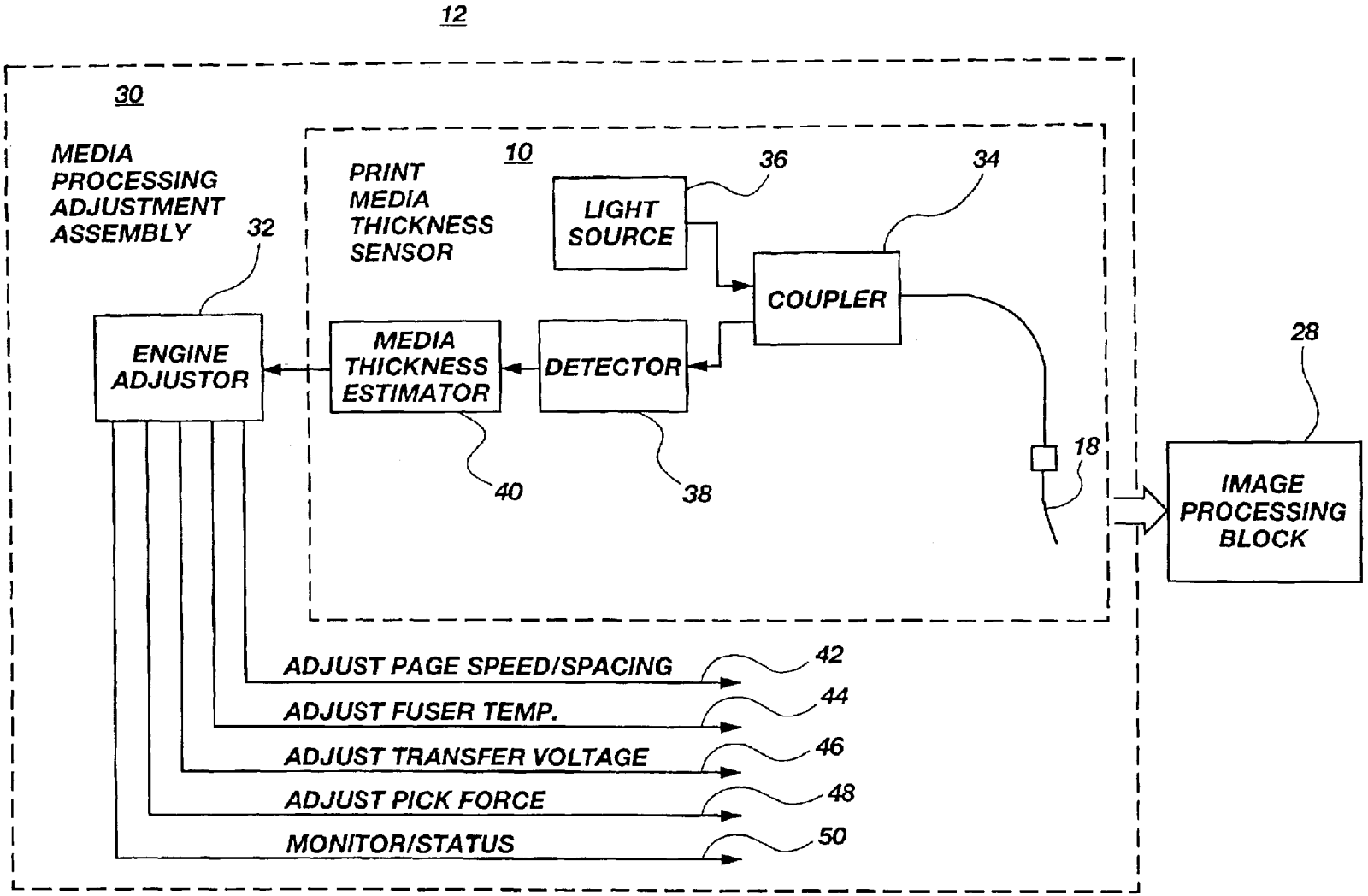
FIG. 7 is a functional block diagram of a document processing device having a media thickness sensor therein, in accordance with an embodiment of the present invention.

FIG. 7 illustrates a functional block diagram of a document processing device 12, in accordance with a preferred embodiment of the present invention. Document processing device 12 includes, among other things, image processing apparatus 28 and a media processing adjustment assembly 30. Image processing apparatus 28 performs conventional imaging processes and may include a controller/formatter and a print engine, and a scanner in the case of copy and facsimile machines. The functionality of these imaging processes are known in the art and their intricacies are not described herein.

Media processing adjustment assembly 30 is comprised of a media thickness sensor 10 and an engine adjuster 32. Media thickness sensor 10 is comprised of various functional elements that are coupled with sensing fiber 18. Such functional elements include an optical coupler 34 for coupling a light source 36 to sensing optical fiber 18 while further allowing reflected light to be detected at the same end of sensing optical fiber 18 by a light reflection detector 38.

The process and methods for coupling one end of an optical fiber to an optical coupler for further coupling with both a light source and a detector is appreciated by those of ordinary skill in the art. One embodiment of the coupler and light source/detector is governed by the principles of the operation of the fiber optic Fabry-Perot interferometer. The mathematical equations governing the deflection correlation to reflected light in addition to the mechanical coupling and identification of suitable parts are known and readily discernable by those of ordinary skill in the art.

Media thickness sensor 10 is further comprised of a media thickness estimator 40 coupled to light reflection detector 38 and optionally coupled to light source 36 for quantifying differences in the reflected light so as to create a gradient of media thicknesses for use by document processing device 12. Media thickness estimator 40, as part of media thickness sensor 10, transfers a paper thickness identifier or gradient value to engine adjuster 32 for use in both status and control applications of components of document processing device 12. Engine adjustor 32 may be implemented as a look-up table of adjustment values comprising calculated or empirical values such as adjustment identifiers that are forwarded to a controller of the document processing device for use in modifying or adapting the image processing apparatus 28. Image processing apparatus 28 may include functionality (not shown) such as a controller that is responsive to signals or commands from engine adjustor 32 and further capable of modifying commands to image processes such as printing and scanning. By way of example and not limitation, exemplary status and control signals for use by document processing device 12 may include a signal for adjusting the roller spacing speed or other interpage gaps illustrated as control signal 42. For example, adjustment of the interpage gap is desirable due to the processing of a thicker media wherein a thicker media requires more energy to be transferred from the fuser thus requiring a longer recovery time for the fuser. Therefore, an adjustment in the interpage gap would allow the fuser to recover without requiring additional energy to be pumped into the fuser.

An additional control signal, illustrated as control signal 44, may adjust the temperature profile for the fuser in the print engine of a laser printer due to variations in media thickness. For example, thicker media requires a different fuser temperature profile for fusing the toner onto the print media. Yet another control signal, depicted as transfer voltage control signal 46, is a voltage that is applied to pull the toner down onto the page, for example, as a media thickness increases, the amount of voltage required to pull or transfer the toner from, for example, a photosensitive drum, increases. Likewise, for thinner print media, the amount of transfer voltage is lessened. Therefore, there are advantages to being able to determine to a relative degree of certainty the specific thickness of the current media in order to optimize the transfer process.

Yet another advantageous control signal that may result from the determination of the media thickness is illustrated as control signal 48 in which the pick force, the force required for retrieving a sheet of media from a tray, may be adjusted according to the media thickness. An example of various pick force mechanisms includes friction rollers as well as vacuum-based media picking techniques. As mentioned above, in addition to control signals, status or monitoring data 50 may also be present for providing statistical or other feedback information to other portions of document processing device 12.

The media thickness sensor described herein provides the ability to detect media thickness in real-time to perform processing adjustments on the current page in process rather than on a processing batch (e.g., print batch) configuration basis. Although the present invention has been described with reference to specific example embodiments, it will be appreciated that it is intended to cover all modifications and equivalents within the scope of the appended claims.

What is claimed is:

1. A print media thickness sensor, comprising:

a flexible optical fiber having a fixed end and a free end extended to physically encounter forces exerted by a print media;

a light source operably coupled to the fixed end of the flexible optical fiber;

a mirror formed to the free end of the flexible optical fiber;

a detector operably coupled to the fixed end of the flexible optical fiber and configured to sense the at least a portion of the light reflected by the mirror through the optical fiber and generate an electronic signal, in response to the at least a portion of the light, corresponding to the deflection of the flexible optical fiber; and a media thickness estimator operably coupled to the detector, the estimator configured to generate, in response to receiving the electronic signal from the detector, a print media thickness indicator corresponding to a thickness of the print media.

2. The print media sensor as recited in claim 1, further comprising a mounting housing for supporting the flexible optical fiber at the fixed end thereby allowing the free end to be deflected when encountering the print media.

3. The print media sensor as recited in claim 1, further comprising a coating disposed about at least the free end of the flexible optical fiber for providing resiliency to the flexible optical fiber when encountering the print media.

4. The print media sensor as recited in claim 3, wherein the coating is configured to flex in a response to the print media and further induces flexure in the flexible optical fiber.

5. The print media sensor as recited in claim 3, wherein the coating is comprised of a material that is resistant to print media abrasion.

6. The print media sensor as recited in claim 1, wherein the mirror comprises an optically shaped free end of the flexible optical fiber.

7. The print media sensor as recited in claim 1, wherein the mirror comprises a reflective coating on the free end of the flexible optical fiber.

8. A media processing adjustment assembly, comprising:

a media thickness sensor, including:

a flexible optical fiber having a fixed end for coupling and a free end extended to physically encounter forces exerted by a print media;

a light source operably coupled to the first end of the flexible optical fiber for generating a light for propagation from the fixed end to the free end of the flexible optical fiber;

a mirror formed to the free end of the flexible optical fiber for reflecting at least a portion of the light from the free end of the flexible optical fiber to the fixed end of the flexible optical fiber;

a detector operably coupled to the fixed end of the flexible optical fiber configured to measure reflected light propagating from the free end to the fixed end of the flexible optical fiber and further configured to generate an electronic signal corresponding to deflection of the flexible optical fiber;

a media thickness estimator operably coupled to the detector, the estimator configured to generate, in response to receiving the electronic signal from the detector, a print media thickness indicator corresponding to a thickness of the print media; and an engine adjustor operably coupled to the print media thickness sensor and configured to generate, in response to the media thickness indicator, control signals for adjusting image processing of the print media in response to the thickness of the print media.

9. The media processing adjustment assembly as recited in claim 8, wherein the engine adjustor further comprises at least one control signal for adjusting processing of the print media.

10. The media processing adjustment assembly as recited in claim 8, wherein the at least one control signal modifies a transfer voltage for printing images onto the print media.

11. The media processing adjustment assembly as recited in claim 8, wherein the print media sensor further comprises a mounting housing for supporting the flexible optical fiber at the fixed end thereby allowing the free end to be deflected when encountering the forces exerted by the print media.

12. The media processing adjustment assembly as recited in claim 8, wherein the print media sensor further comprises a coating disposed about at least the free end of the flexible optical fiber for providing resiliency to the flexible optical fiber when encountering the print media.

13. The media processing adjustment assembly as recited in claim 8, further comprising a media deflector for inducing deflection of the media while the media induces deflection of the flexible optical fiber.

14. The media processing adjustment assembly as recited in claim 8, further comprising a media guidance profile for deflecting during an encounter with the media, the media guidance profile for encountering the optical fiber and causing a deflection therein.

15. A document processing device, comprising:

a media processing adjustment assembly, including:

a media thickness sensor, including a light source and a detector operably coupled to a fixed end of a flexible optical fiber and a reflective mirror operably coupled to a free end of the flexible optical fiber, the media thickness sensor further including a media thickness estimator operably coupled to the detector and configured to generate a print media thickness indicator, in response to receiving an electronic signal from the detector corresponding to at least a portion of light originated by the light source and reflected by the mirror;

an engine adjustor operably coupled to the print media thickness sensor and configured to generate, in response to the media thickness indicator, control signals for adjusting image processing of the print media in response to the thickness of the print media; and an image processing apparatus adjustable by the media thickness adjustment assembly for processing the print media.

16. The document processing device as recited in claim 15, wherein the media thickness adjustment assembly further comprises at least one control signal for adjusting processing of the print media.

17. The document processing device as recited in claim 16, wherein the at least one control signal modifies a transfer voltage for printing images onto the print media.

* * * * *